United States Patent [19]

Toor et al.

[11] Patent Number: 4,979,531

[45] Date of Patent: Dec. 25, 1990

[54] TENT POLE AND METHOD OF MANUFACTURE THEREFOR

[76] Inventors: John W. Toor, 425 Alma St., #311; James E. Sacherman, 446 Ruthvea, both of Palo Alto, Calif. 94301

[21] Appl. No.: 285,289

[22] Filed: Dec. 15, 1988

Related U.S. Application Data

[63] Continuation of Ser. No. 173,312, Mar. 25, 1988, abandoned.

[51] Int. Cl.[5] ..... E04H 15/40; E04H 15/60

[52] U.S. Cl. ..... 135/104; 135/114; 135/905; 403/99

[58] Field of Search ..... 135/104, 109, 114, 905; 403/3, 99

[56] References Cited

U.S. PATENT DOCUMENTS

| | | | |
|---|---|---|---|
| 3,448,748 | 6/1969 | Walrave | 135/114 X |
| 3,635,233 | 1/1972 | Robertson | 135/114 X |
| 3,635,233 | 1/1972 | Robertson | 135/114 X |
| 3,730,544 | 5/1973 | Hyman | 280/819 |
| 3,794,054 | 2/1974 | Watts | 135/104 X |
| 3,834,410 | 9/1974 | Leibel | 135/104 |
| 4,063,830 | 12/1977 | Ban | 403/3 |

FOREIGN PATENT DOCUMENTS

| | | | |
|---|---|---|---|
| 1182052 | 6/1959 | France | 135/114 |
| 1301413 | 7/1962 | France | 135/114 |

*Primary Examiner*—Henry E. Raduazo
*Assistant Examiner*—Lan Mai
*Attorney, Agent, or Firm*—Harrison & Eakin

[57] ABSTRACT

A flexible, multi-segmented support structure, and method for manufacturing same, particularly suited for use as a tent pole, wherein the support structure includes a plurality of tubular segments and each segment is connected to its adjacent segment or segments by lengths of elastic shock cord, the cord having sleeves affixed to each end thereof which can be affixed in partly or fully automated fashion to the respective segments. A novel ferrule is included to provide rigidity at the junctions of the segments, without providing undue stress concentration and to further assist in automating the manufacturing process.

19 Claims, 1 Drawing Sheet

TENT POLE AND METHOD OF MANUFACTURE THEREFOR

This application is a continuation of application Ser. No. 07/173,312, filed Mar. 25, 1988 now abandoned.

FIELD OF THE INVENTION

This invention relates to flexible frame support structures, and more particularly relates to collapsible components forming a flexible frame for structures such as tents.

BACKGROUND OF THE INVENTION

Tent poles which utilize elastic shock-cord to cause multiple tent pole segments to be joined together into a single tent support are known in the art. In such structures, the segments are typically made of pultruded fiberglass, aluminum or, less frequently, other materials. Each segment will have at least a ferrule on one end, and some include mating ferrules on each end. The ferrules are typically made of steel, and are glued onto the tent pole segments.

The elastic shock-cord is fastened at one end of the first segment and then threaded through each of the remaining segments of the pole. The cord is then terminated at the opposite end of the final segment. The ferrules are arranged so that when the shock-corded segments are released, each segment will be mated into the ferrule of the adjacent segment, resulting in a fully connected tent pole.

Although shock-corded tent poles as described above have been well accepted in the industry, such poles have numerous shortcomings. First, the shock cord elastic must be strung through the entirety of each segment, which to date has required that assembly be done manually, and also uses more elastic than actually required to connect the segments. This requirement for manual assembly has the additional disadvantage of virtually mandating overseas production, because of the substantial differential in labor rates in the United States versus foreign countries.

A second disadvantage results from the use of the steel ferrule on the end of the fiberglass segment. The steel ferrules have substantially less flexibility than the fiberglass segments, causing a severe stress concentration in the fiberglass at the end of the ferrule. This stress concentration leads to breakage of the pole segments; virtually all breakage of such tent poles occurs at the end of a ferrule. Moreover, one of the most common failures of a tent today is breakage of a tent pole.

A third disadvantage of existing designs for tent poles also relates to the use of the steel ferrule. Gluing of the ferrule to the end of the segment is labor intensive and unreliable. A fourth disadvantage is that repair of existing shock corded tent poles requires complete disassembly of the broken pole, replacement of the broken segment, and rethreading of the elastic shock cord. Such repairs are difficult and proceed slowly.

There has therefore been a need for a tent pole and a method of manufacture of such poles which lessens the shortcomings of the prior art.

SUMMARY OF THE INVENTION

The present invention resolves or substantially lessens the limitations of the prior art by providing a shock corded tent pole and a method of manufacturing the same which can be highly automated.

The tent pole of the present invention includes a segment of pultruded fiberglass tubing similar to that used in the prior art. Sleeves are crimped on at least one end, and typically each end, of a continuous length of elastic. The elastic segment defined by the two crimp-on sleeves is then cut from the continuous length of elastic, and the first of the sleeves is pressed into the fiberglass tubing. The other sleeve can be press-fit or otherwise fastened to the ferrule.

The ferrule is then connected to the next segment of the tent pole, resulting in a shock corded pair of tent pole segments. Additional segments can be added as necessary to achieve any desired of length of tent pole.

It is therefore one object to provide an improved tent pole construction.

It is another object of the present invention to provide a tent pole construction which can be assembled in automated fashion.

It is yet another object of the present invention to provide a method of fabricating shock corded tent poles which can be partly or fully automated.

It is yet another object of the present invention to provide a shock corded tent pole in which the elastic shock cord does not extend throughout each of the tent pole segments.

It is yet another object of the present invention to provide a ferrule suitable for use in a flexible, shock corded tent pole having multiple segments which lessens stress concentrations in the segments at the end of the ferrule.

These and other objects of the present invention will be better appreciated from the following Detailed Description of the Invention, taken together with the attached

FIGURES in which

Figure 3C:
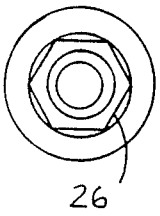
Figure 3B:
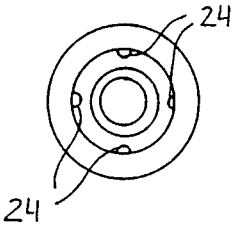
Figure 3A:
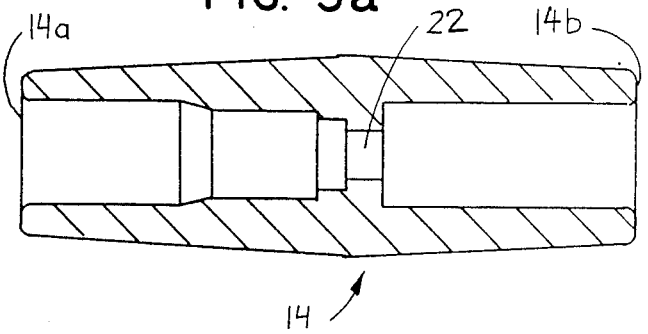

FIG. 3*a* shows one example of a ferrule according to the present invention, with the end bore of the ferrule have a circular cross-section; and FIGS. 3*b* and 3*c* show examples of alternative cross-sections for the ferrule of FIG. 3*a*.

DETAILED DESCRIPTION OF THE INVENTION

Figure 1:
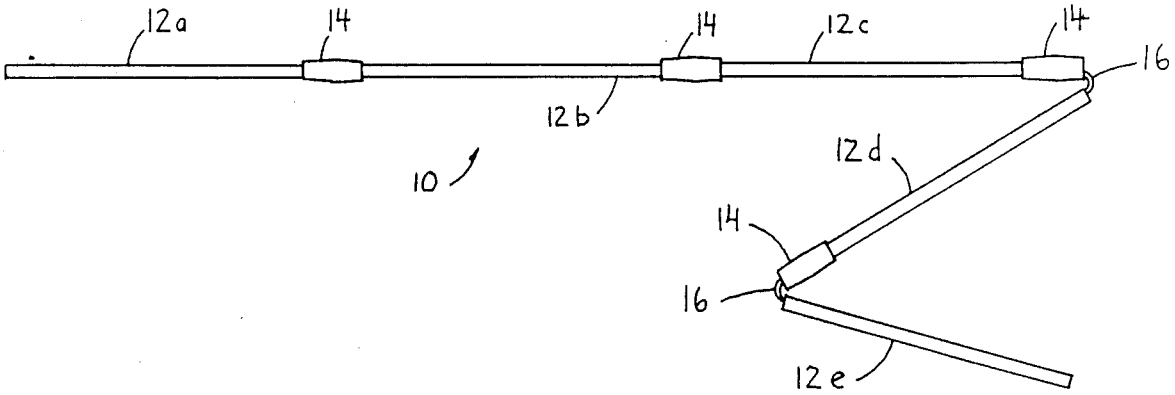
FIG. 1 shows a multi-segmented, flexible tent pole according to the present invention, with the segments stretched apart to reveal the elastic shock cord therebetween.

Referring first to FIG. 1, a multi-segmented flexible tent pole 10 according to the present invention is shown therein. While the typical application of the present invention is a tent pole, it is to be understood that the method and apparatus of the present invention have applications other than for use with tent poles. The invention, while particularly applicable to tent poles, is therefore to be understood to apply generally to support structures, and particularly to collapsible support structures.

The tent pole 10 of FIG. 1 can be seen to include a plurality of tent pole segments 12*a–e*. The segments 12 are typically made of pultruded fiberglass tubing, although in some applications aluminum, steel, or other materials may be used successfully. At one end of all but the last segment is a ferrule 14, which is preferably designed to be affixed to an end of the respective segment 12 by means of a press-fit, as described in greater detail in connection with FIG. 3.

The other end of the ferrule 14 is shaped to slip readily over the mating end of the adjacent segment to permit the multiple segments to be joined into a single support structure.

Thus, for example, one end of the segment 12*a* is fixedly attached to one side of the ferrule 14, and the mating end of segment 12*b* may be removably fitted into the opposing side of the same ferrule 14.

Connecting the segments 12*a–e* are lengths of elastic shock cord 16, which in FIG. 1 can be seen to extend from the ferrule 14 into the mating end of the adjacent segment 12. As with conventional shock corded tent poles, the elastic shock cord 16 permits the segments 12 of the tent pole 10 to be pulled apart and folded against one another for stowage, but also provides sufficient force to pull the segments together until they are substantially linked into a single pole. The lengths of elastic shock cord are preferably of sufficient length to permit a few inches separation between the segments without reaching the elastic limit of the cord 16; typically, the cord 16 will be on the order of three to six inches in unstretched length, and stretched to a length on the order of five to seven or more inches, or about 130% of unstretched length, when the ferrule 14 is pulled onto the mating tubing segment 12. The elastic limit of the shock cord typically will be reached at about 200% of its unstretched length, although significant variation from this limit is acceptable.

Figure 2:
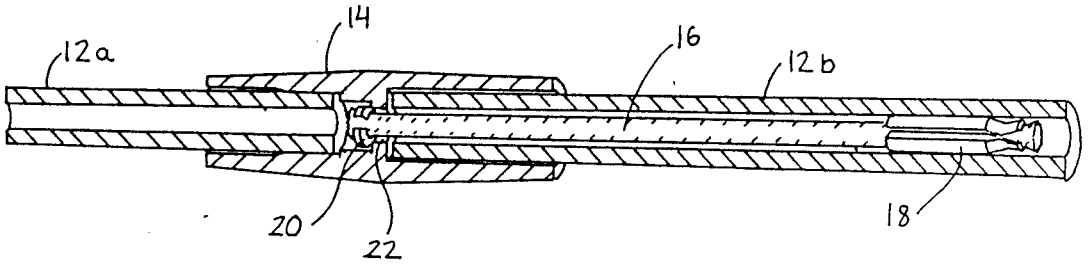
FIG. 2 shows in breakaway form a portion of one segment of the tent pole and mating ferrule including the crimp sleeves at the ends of the elastic shock cord and the location of the crimp sleeves within the segment and the ferrule.

Referring next to FIG. 2, the method by which the length of elastic shock cord 16 is affixed to the adjacent tent pole segments 12 can be better appreciated. The first tent pole segment 12*a*, shown in partial breakaway, reveals a crimp-on friction sleeve 18 at the end of the length of cord 16. A second crimp-on sleeve 20 is affixed to the other end of the length of cord 16. The sleeve 20 may be affixed to the ferrule 14, or alternatively may extend through the ferrule 14 into the segment 12*b*. The crimp-on sleeves 18 and 20 are typically slit metal cylinders which are affixed to the cord 16 by compression, although other types of sleeves will also work.

The crimp-on friction sleeve 18 is driven a few inches down the end of the tubular segment 12*a*, where it is fixedly retained. The sleeve 18 may be provided with small barbs or other retention aids. Because the sleeve is driven only a few inches down the tube, the assembly of the sleeve (and elastic affixed thereto) into the tubing may be partly or readily automated. Assembly may further be simplified by making the sleeve 18 smaller than the sleeve 20, and molding or otherwise forming a hole 22 in the ferrule 14 of a size which permits the sleeve 18 but not the sleeve 20 to pass therethrough. In such an embodiment, where the end of the elastic cord 16 is fastened to the ferrule 14, a simple knot may be substituted for the sleeve 20 in at least some instances.

In this approach, the removable side of the ferrule 14 is placed over the mating end of the segment 12, and the sleeve 18 and attached elastic cord 16 are passed therethrough. The sleeve 18 is then driven down the tubular segment 12 until fixedly located.

At this point the sleeve 20 (or knot) at the other end of the cord 16 retains the ferrule, which has exposed the side intended to be press-fit to an adjacent segment 12. The next segment 12 may then be press-fit onto the ferrule, thereby joining the two adjacent segments 12. This process, which may readily be automated, can be repeated as many times as necessary to achieve desired pole lengths.

It will be appreciated by those skilled in the art that pultruded fiberglass tubing is relatively strong in axial tension and flexure, but not in radial tension. It is therefore important that the sleeve 18 be of sufficient length to reduce radial tension within the tube to acceptable limits. For nominal 5/16" outside diameter pultruded fiberglass tubing, the length of the sleeve 18 is preferably at least one inch, although a wide range of other sizes will work with varying degrees of success, depending on the application. Likewise, the sleeve 18 is typically driven about five inches down the segment 12, although other depths are acceptable depending upon the application and performance characteristics desired.

Referring next to FIG. 3*a*, the ferrule 14 of the present invention may be better appreciated. Unlike the straight steel ferrules of the prior art, the ferrule 14 is made of plastic, typically through injection molding. One acceptable plastic is Nylon 6-6 with 30% glass fill; generic characteristics of acceptable materials are a tensile strength greater than 20,000 p.s.i., with a modulus of elasticity less than 1,000,000 p.s.i., although materials not greatly outside this range may also be acceptable. The plastic ferrule is more flexible than the prior art steel ferrule, and thus substantially reduces the stress concentrations found in fiberglass tubing where steel ferrules are used.

To further reduce such stress concentrations, the ferrule 14 can be seen in FIG. 3 to be tapered, such that it is widest at the center, and thinner at each end. The ferrule is therefore stiffer at the middle, where it receives no structural support from the segment 12, and more flexible at the ends, where it receives support from the segment 12 but could also cause stress concentration in the fiberglass. The effect of the taper, combined with the use of a material more flexible than steel, is to create a relatively gentle transition at the junctions of adjacent segments. The taper will also assist in removing the ferrule 14 from the mold. In a typical ferrule for use with 5/16" o.d. tubing, the thickness of the ferrule wall at the center may be on the order of 0.09", while the thickness of the ferrule wall at the end may be on the order of 0.06". These thicknesses will typically vary with the flexural characteristics desired for a specific application.

As with the length of the sleeve 18, it will be appreciated that the length of the ferrule 14 can have an effect on the stress concentrations in the segment 12. For nominal 5/16" diameter tubing, a ferrule length on the order of 1.25" per side has been found acceptable, although a wide range of lengths will be appropriate depending on tubing material selected, amount of flexure desired, and other aspects of the application.

As previously described in connection with FIG. 1, side 14*a* of the ferrule 14 is molded to provide a bore of a smaller inside diameter than the bore on the other side 14*b*. This permits side 14*a* of the ferrule to be press-fit onto one end of a segment of tubing 12, while permitting an adjacent tubing segment to be removably inserted into side 14*b* of the ferrule. Because of the greater flexibility of the molded plastic ferrule 14 than the steel prior art, side 14*a* may be reliably press-fit over a wide tolerance range of a nominal tube diameter. This avoids many of the reliability problems associated with gluing of steel ferrules. Moreover, a press-fit technique is more readily automated.

To further assist in maintaining good retention with a press-fit ferrule, the bore of side 14*a* may be formed with ribs 24 therein, as shown in FIG. 3*b*, rather than the circular bore of FIG. 3*a*. Alternatively, the entire interior bore may be formed as a polygon 26 as shown in FIG. 3*c*, such as an octagon or a hexagon.

The use of a short length of elastic cord 16, fastened at one end to the ferrule 14 and at the other end into the segment 12, where the ferrule 14 is press-fit onto the adjacent segment 12, also simplifies repair. To repair a broken segment, the press-fit ferrule can be removed with some reasonable amount of force, the broken segment replaced, and the ferrules again press fit onto the appropriate segments of tubing.

Having fully described one embodiment of the invention and various alternatives, it will be appreciated by those skilled in the art, given the teachings herein, that numerous alternatives and equivalents exist which do not depart from the invention. It is therefore to be understood that the invention is not to be limited by the foregoing description, but rather only by the appended claims.

What is claimed is:

1. A method for manufacturing multi-segmented poles comprising providing a plurality of tubing segments, providing a length of elastic cord, crimping a first sleeve onto the elastic cord at a first location, terminating the elastic cord at a second location, passing the length of elastic cord through a ferrule, driving the first sleeve into the end of one of the plurality of tubing segments, attaching the ferrule to a second of the plurality of tubing segments.

2. A multi-segmented support structure or pole comprising a plurality of tubing segments, each tubing segment having first and second ends.

at least one ferrule, each affixed to the second end of a tubing segment, and at least one length of elastic shock cord, each length having a first sleeve at one end and a termination at the other end, the first sleeve being affixed to the first end of one of the plurality of tubing segments and the termination being retained by an associated one of the plurality of ferrules.

3. A ferrule for use with a multi-segmented pole comprising a first conical section having a base of a first diameter and an end of a smaller diameter, there being a bore of a first diameter and a predetermined depth in the end thereof for being press-fit over a piece of tubing, a second conical section having a base of substantially the same diameter as the base of the first conical section and an end of a smaller diameter, there being a bore of a predetermined diameter and depth in the end thereof for removably fitting over a piece of tubing, and the first and second conical sections being plastic and being formed as a unit.

4. The invention of claim 1 wherein the step of terminating the elastic cord is done by tying a knot therein.

5. The invention of claim 1 wherein the step of attaching the ferrule to the second of the plurality of tubing segments is accomplished by press-fitting the ferrule onto such tubing segment.

6. The invention of claim 1 wherein the step of passing the length of elastic cord through the ferrule occurs after the steps of crimping the first and second sleeves onto the elastic cord.

7. The invention of claim 1 wherein the ferrule is plastic.

8. The invention of claim 7 wherein the plastic ferrule is formed by molding.

9. The invention of claim 2 wherein the ferrules are plastic.

10. The invention of claim 2 wherein the ferrules are tapered such that the diameter at the midpoint of the ferrule is greater than the diameter at either end of the ferrule.

11. The invention of claim 2 wherein the tubing segments are formed of pultruded fiberglass.

12. The invention of claim 11 wherein the first sleeve is a friction sleeve, and is affixed to the associated tubing segment by being driven a predetermined distance into the first end of such tubing segment.

13. The invention of claim 2 wherein the first sleeve is at least one-half inch long.

14. A multi-segmented support structure or pole comprising a plurality of tubing segments, each tubing segment having first and second ends, a plurality of ferrules, each affixed to the first end of a tubing segment, and plurality of lengths of elastic shock cord, each length extending through one of the plurality of ferrules and having a first sleeve at one end and a second sleeve at the other end, the first sleeve being affixed to the first end of one of the plurality of tubing segments and the second sleeve being affixed to the second end of the adjacent one of the plurality of tubing segments.

15. The invention of claim 3 wherein the ferrule is formed by molding.

16. The invention of claim 15 wherein deformable element means are molded into the end bore of the first conical section for aiding in press-fitting the ferrule over a piece of tubing.

17. The invention of claim 16 wherein the deformable element means are ribs.

18. The invention of claim 16 wherein the deformable elements are polygonal elements.

19. The invention of claim wherein the step of terminating the elastic cord is done by affixing a second sleeve thereto.

* * * * *